US009186005B1

(12) United States Patent
Ferrier, Jr.

(10) Patent No.: US 9,186,005 B1
(45) Date of Patent: Nov. 17, 2015

(54) LUMINESCENT VESSEL FOR CONTAINMENT OF DRINK WITH ACCOMPANYING LUMINESCENT COASTER BASE

(71) Applicant: Ted Lawrence Ferrier, Jr., Burns, KS (US)

(72) Inventor: Ted Lawrence Ferrier, Jr., Burns, KS (US)

( * ) Notice: Subject to any disclaimer, the term of this patent is extended or adjusted under 35 U.S.C. 154(b) by 0 days.

(21) Appl. No.: 13/999,999

(22) Filed: Apr. 14, 2014

Related U.S. Application Data

(60) Provisional application No. 61/853,841, filed on Apr. 15, 2013.

(51) Int. Cl.
*A01B 1/00* (2006.01)
*A47G 19/22* (2006.01)

(52) U.S. Cl.
CPC .... *A47G 19/2227* (2013.01); *A47G 2019/2238* (2013.01)

(58) Field of Classification Search
CPC ..... A47G 19/2227; A47G 2019/2238
See application file for complete search history.

(56) References Cited

U.S. PATENT DOCUMENTS

| | | | |
|---|---|---|---|
| 2,360,516 | A | 10/1944 | Schmidling |
| 2,577,030 | A | 12/1951 | Neuman |
| 3,017,051 | A | 1/1962 | Rosenfeld |
| 4,261,026 | A | 4/1981 | Bolha |
| 4,336,574 | A | 6/1982 | Goodman |
| 4,344,113 | A | 8/1982 | Ditto |
| 4,563,726 | A | 1/1986 | Newcomb |
| 4,759,453 | A | 7/1988 | Paetzold |
| 5,624,177 | A | 4/1997 | Rosaia |
| 5,695,270 | A | 12/1997 | Collet |
| 6,354,711 | B1 | 3/2002 | McCoy |
| 6,631,819 | B1 | 10/2003 | Ghanem |
| 6,921,179 | B2 | 7/2005 | Diak Ghanem |
| 7,017,736 | B2 | 3/2006 | Cohen |
| 7,229,181 | B2 | 6/2007 | Ghanem |
| D670,419 | S | 11/2012 | Fissell |

*Primary Examiner* — Elmito Breval
(74) *Attorney, Agent, or Firm* — Kenneth H. Jack; Davis & Jack, L.L.C.

(57) ABSTRACT

A luminescent vessel for containment of drink and its accompanying luminescent coaster base, each provided with bands of energy absorbing photo-luminescent material, emit bright and long lasting luminescent light making both the vessel and coaster base visible for hours when in a darkened environment. This visibility during the dark makes it possible that a sleeping person, awakening and desiring liquid, can see the nearby vessel, take it from the coaster base, use the vessel, and then return it securely to the illuminated coaster base without incident of spill or disturbance of the darkened environment.

10 Claims, 6 Drawing Sheets

DETAIL B

SECTION A-A

DETAIL C

DETAIL F

DETAIL G

SECTION E-E

DETAIL J

DETAIL K

SECTION H-H

LUMINESCENT VESSEL FOR CONTAINMENT OF DRINK WITH ACCOMPANYING LUMINESCENT COASTER BASE

CROSS REFERENCE TO RELATED APPLICATIONS

This application claims the benefit of provisional patent application Ser. No. 61/853,841, filed 2013 Apr. 15 by the present inventor, which is incorporated by reference.

BACKGROUND

This application relates to water vessels, particularly those which provide a luminescent capacity.

PRIOR ART

U.S. patents

| Pat. No. | Kind Code | Issue Date | Patentee |
|---|---|---|---|
| 2,577,030 | | Dec. 4, 1951 | Neumann |
| 7,017,736 | | Mar. 28, 2006 | Cohen et al |
| 7,229,181 | B2 | Jun. 12, 2007 | Ghanem |
| 6,921,179 | B2 | Jul. 26, 2005 | Ghanem |
| 4,344,113 | | Aug. 10, 1982 | " et al |
| 5,695,270 | | Dec. 9, 1997 | Collet |
| 3,017,051 | | Jan. 16, 1962 | Rosenfeld |
| 6,082,866 | | Jul. 4, 2000 | Amedee |
| 4,261,026 | | Apr. 7, 1981 | Bolha |

The efforts to incorporate different forms of illumination with drinking glasses, coasters and plates used in a darkened environment, are well represented in patent records of the USPTO. These efforts produced illumination by diverse means. Examples of these follow: batteries and bulbs, see: U.S. Pat. No. 4,261,026, (1981) Bolha; the co-mingling of two-part chemical-luminescent materials, see: U.S. Pat. No. 7,017,736, (2006) Cohen; and phosphorescent photo-luminescent materials, see: U.S. Pat. No. 6,921,179, (2005) Ghanem.

It is evident from reading numerous patents, 9 of which are cited here as relevant prior art, the primary object of prior efforts to incorporate illumination with a drinking glass, plate or coaster was to lend decorative and artistic affect to the glass, plate or coaster. This was accomplished with drinking glasses by affixing decorative figures and characters made from photo-luminescent material on the wall of the glass. These decorative and artistic figures and characters may have achieved artistic affect, but the duration of the resultant dull luminescent after-glow was short lived. The luminescent figures were limited in capacity to absorb light energy. This deficiency in absorbed light energy limited the brightness and duration of the emitted luminescence from the glasses in a darkened environment.

The general principle of phosphorescent or photo-luminescent lighting is the provision of a surface adapted to absorb light while exposed to it and emit light after that energizing light is extinguished. As a consequence of this, the brightness and duration of after glow light of any particular photo-luminescent material is directly related to the area of its energy absorbing surface. The greater the energy absorbing surface area of the photo-luminescent material, the brighter, more enduring the luminescent after glow.

This principle of photo-luminescent lighting does not appear to have been considered a directive in the employment of photo-luminescent material in the patents which have been examined here.

Advantages

Accordingly principal advantages of one or more aspects are as follow:

Bright and long lasting luminescent after-glow is emitted by the enlarged superior surface of the energy absorbing horizontal bands of photo-luminescent material which encircle the vessel and the coaster base The emitted luminescent after glow of both the vessel and its coaster base in a dark environment make it possible to (1) see the vessel for acquiring it for use, and then (2) see the coaster base enabling secure replacement of the vessel on its base.

Other advantages of one or more aspects will be apparent from a consideration of the drawings and ensuing description.

SUMMARY

In accordance with one embodiment, a Luminescent Vessel for Containment of Drink with Accompanying Luminescent Coaster Base comprises a drinking glass and its coaster base, with luminescent bands encircling both the glass and the coaster base.

DRAWINGS

Figures

Figure 13:
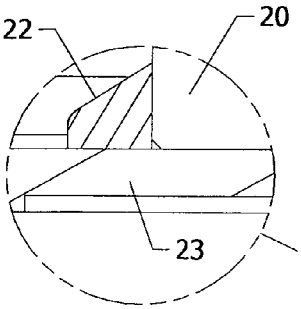
Figure 11:
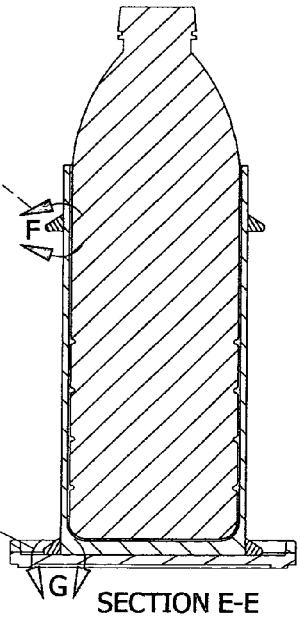
FIG. 11 is a sectional elevation view in detail of the portion indicated by section line E-E in FIG. 10
Figure 14:
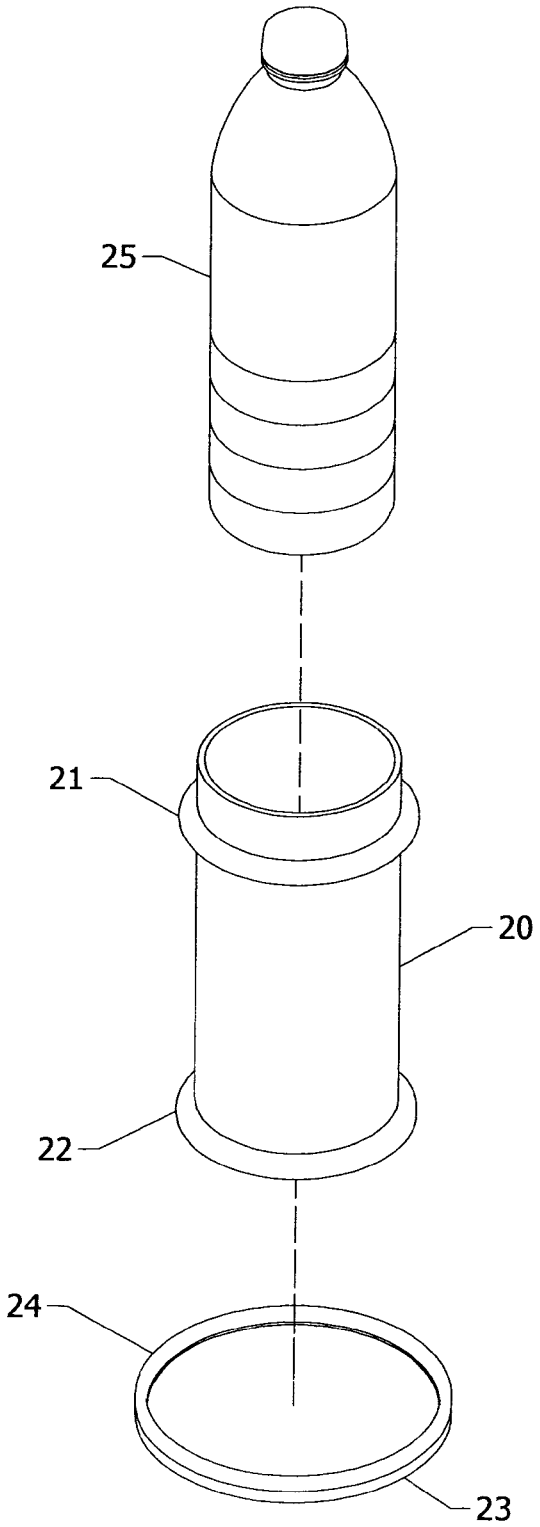
Figure 15:
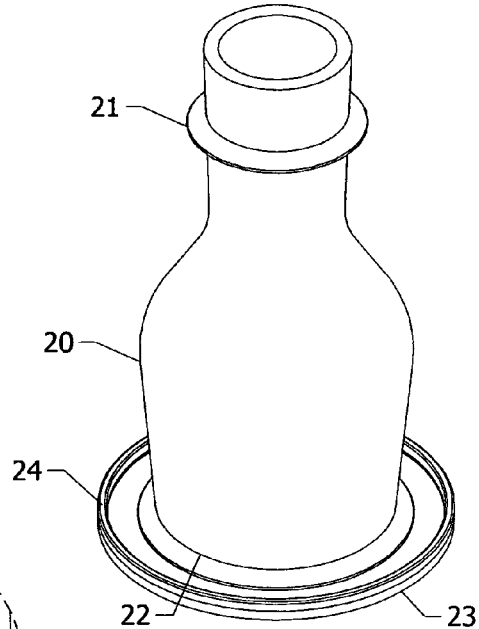
Figure 16:
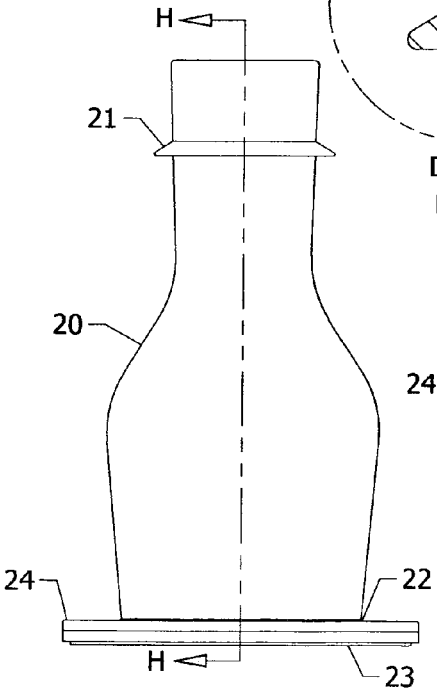

FIG. 13 is a sectional detail view of the bottom luminescent band on the bottled water bottle receptacle FIG. 14 is a 3D exploded view of the bottled water bottle receptacle/coaster base embodiment of a luminescent vessel for containment of drink with accompanying luminescent coaster base FIG. 15 is a 3D isometric view of a carafe/coaster base embodiment of a luminescent vessel for containment of drink with accompanying luminescent coaster base FIG. 16 is a frontal elevation view of the carafe/coaster base of FIG. 15

Figure 17:
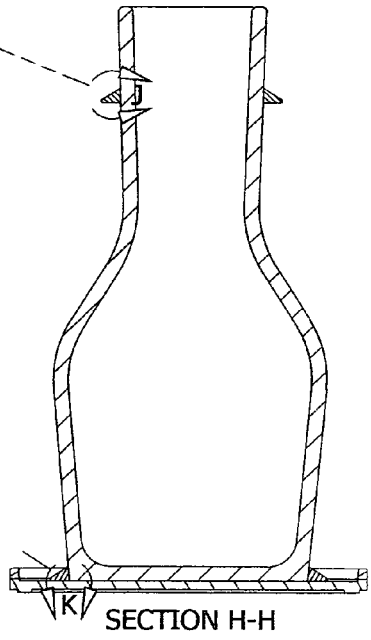

FIG. 17 is a sectional elevation view in detail of the portion indicated by section line H-H in FIG. 16

Figure 18:
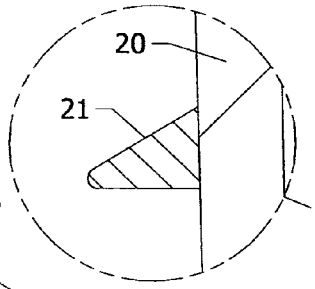

FIG. 18. is a sectional detail view of the top luminescent band on the carafe of FIG. 15

Figure 19:
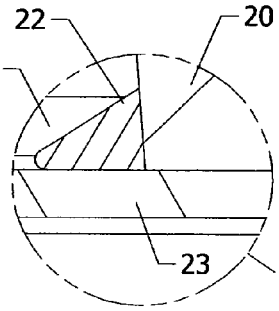

FIG. 19 is a sectional detail view of the bottom luminescent band on the carafe of FIG. 15

DRAWINGS

Reference Numerals

Figure 2:
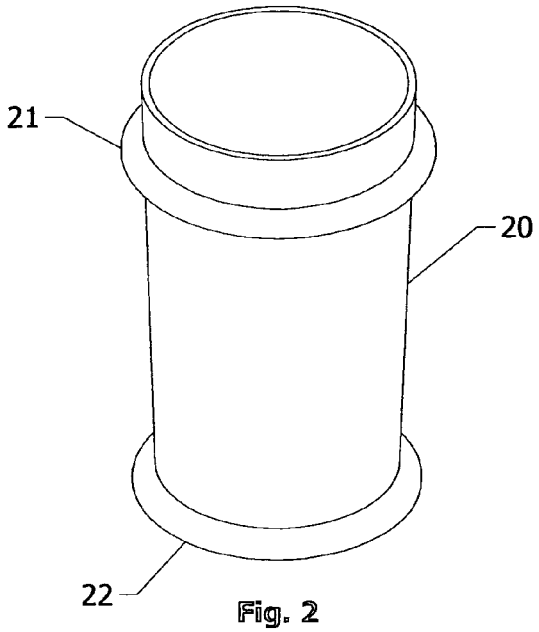
FIG. 2 is a 3D isometric view of the drinking glass with luminescent bands of FIG. 1
Figure 3:
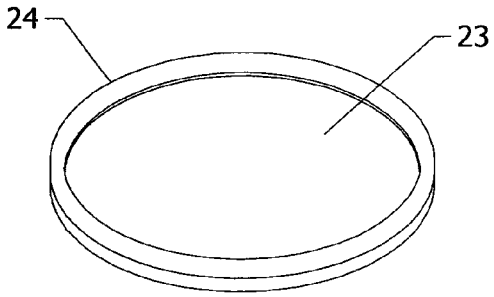
FIG. 3 is a 3D isometric view of the coaster base with luminescent band of FIG. 1
Figure 1:
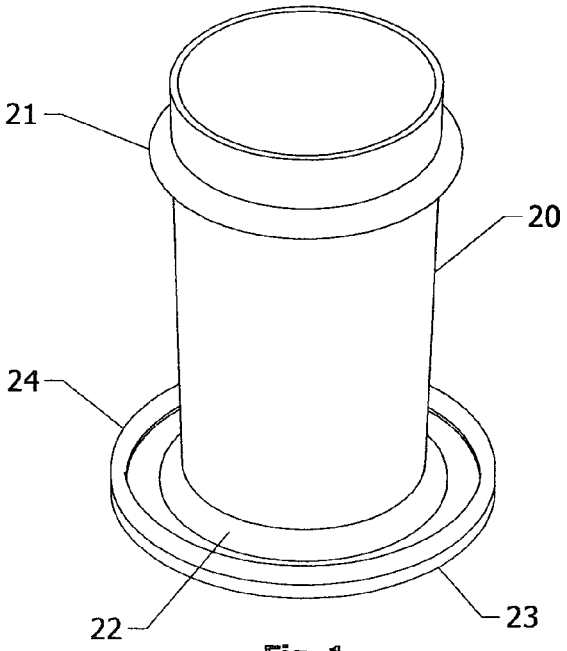
FIG. 1 is a 3D isometric view of a drinking glass/coaster base embodiment of a luminescent vessel for containment of drink with accompanying luminescent coaster base
Figure 4:
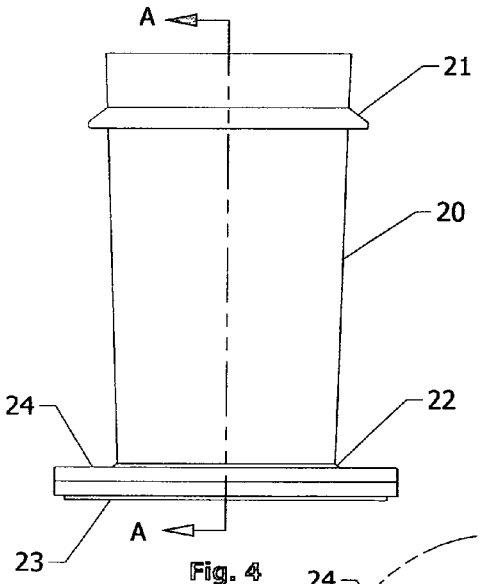
FIG. 4 is a frontal elevation view of the drinking glass/coaster base of FIG. 1
Figure 6:
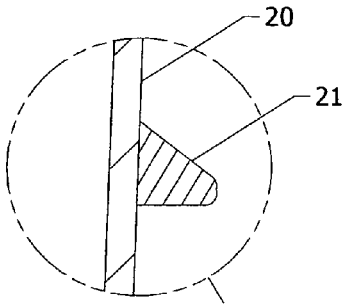
FIG. 6 is a sectional detail view of the top luminescent band on the drinking glass of FIG. 1
Figure 5:
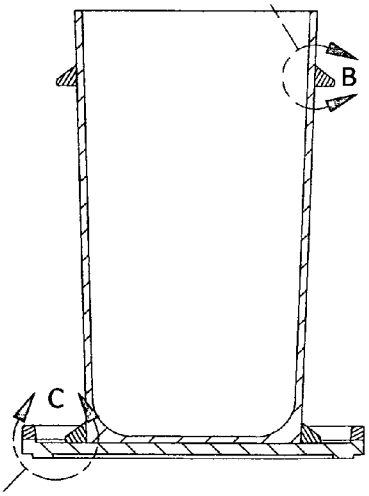
FIG. 5 is a sectional elevation view in detail of the portion indicated by section line A-A in FIG. 4
Figure 7:
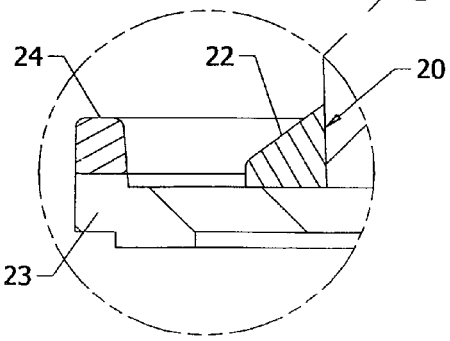
FIG. 7 is a sectional detail view of the luminescent band on the perimeter of the coaster base and the bottom luminescent band on the drinking glass of FIG. 1
Figure 8:
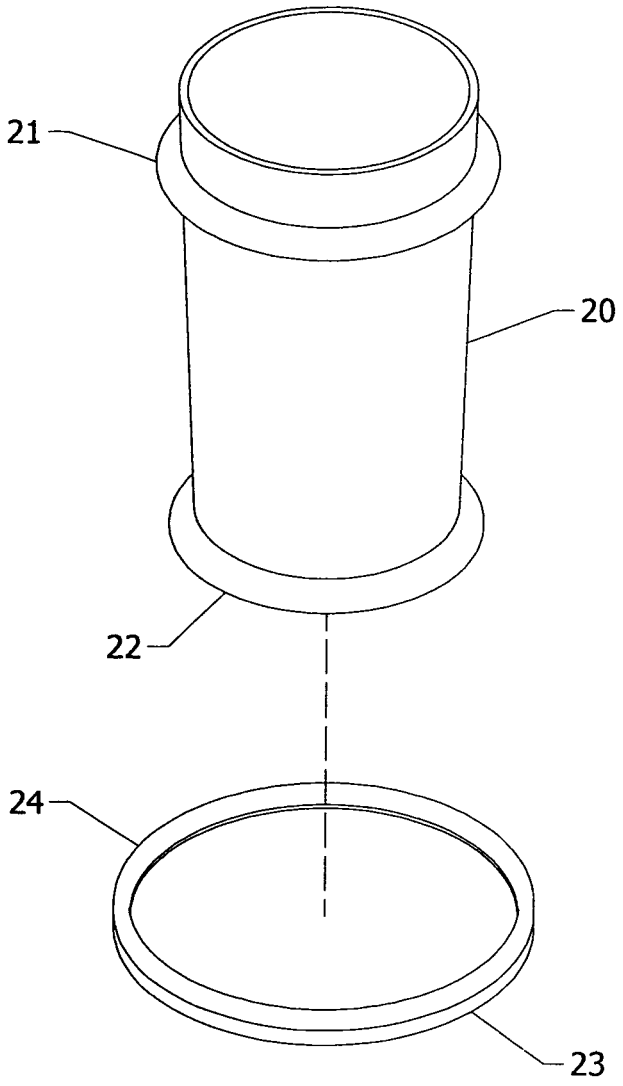
FIG. 8 is a 3D exploded view of the drinking glass/coaster base embodiment
Figure 9:
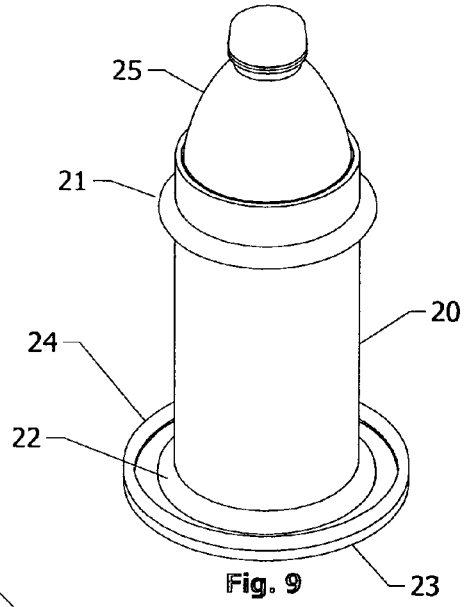
FIG. 9 is a 3D isometric view of a bottled water bottle receptacle/coaster base embodiment of the luminescent vessel for containment of drink with accompanying luminescent coaster base
Figure 12:
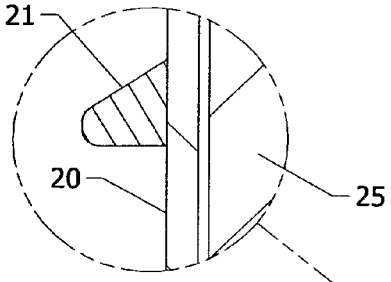
FIG. 12 is a sectional detail view of the top luminescent band on the bottled water bottle receptacle of FIG. 9
Figure 10:
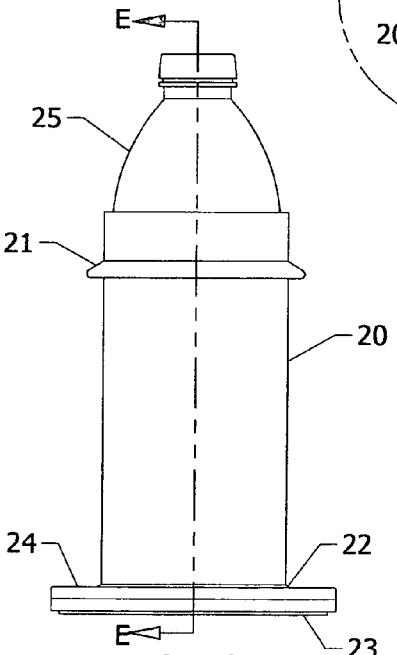
FIG. 10 is a frontal elevation view of the bottled water bottle receptacle/coaster base of FIG. 9

Ref 20 is the body of the vessel of FIG. 1, FIG. 9, FIG. 15

Ref. 21 is the top luminescent band on the vessel of FIG. 1, FIG. 9, FIG. 15

Ref 22 is the bottom luminescent band on the vessel of FIG. 1, FIG. 9, FIG. 15

Ref 23 is the body of the coaster base of FIG. 1, FIG. 9, FIG. 15

Ref 24 is the luminescent band on the coaster base of FIG. 1, FIG. 9, FIG. 15

Ref 25 is a bottle for bottled water of FIG. 9

DETAILED DESCRIPTION

FIGS. 1, 2, 3, 4, 5, 6, 7 and 8

First Embodiment

First embodiment of the luminescent vessel with luminescent coaster base is illustrated in FIGS. 1 through 8, which include 3D isometric, frontal elevation, sectional elevation, sectional detail, and 3D exploded views of a luminescent drinking glass and/or a luminescent coaster base A top band of molded luminescent plastic 21 and a bottom band of molded luminescent plastic 22 are each bonded to the exterior wall of the molded plastic body 20 of the drinking glass of first embodiment. A band of molded luminescent plastic 24 is bonded to the molded plastic body 23 of the coaster base at the perimeter of the coaster base. The bonded band 24 is the luminescent rim of the coaster base.

OPERATION

FIGS. 1 through 8

Once the body 20 of the drinking glass has been molded and luminescent bands 21 and 22 are bonded to the body 20 of the drinking glass, and luminescent band 24 has been bonded to the body 23 of the coaster, the luminescent drinking glass and coaster base are in operational mode. Energizing the luminescent material in the bands of the drinking glass and coaster base is accomplished by daily placing the drinking glass and coaster in direct sun light or lamp light for 40 minutes.

FIGS. 9 through 14

Additional Embodiment

FIGS. 9 through 14, which include 3D isometric, frontal elevation, sectional elevation, sectional detail and 3D exploded views of a luminescent bottled water bottle receptacle with its luminescent coaster base

FIGS. 15 through 19

Alternative Embodiment

FIGS. 15 through 19, including 3D isometric, frontal elevation, sectional elevation, and sectional detail views of a luminescent carafe with its luminescent coaster base Since modification within the spirit and scope of the invention may be readily effected by persons skilled in the art, it is to be understood that the invention is not limited to the particular embodiments described, by way of examples, herein above.

Advantages

The capacity to see the luminescent water vessel in the dark, making it practical to pick it up and use it, and then able to see the luminescent coaster base, to return the vessel to the coaster base without incident of spill or disruption of night time environment.

CONCLUSION, RAMIFICATIONS, AND SCOPE

The work and items, i.e. luminescent drinking glass and luminescent coaster base embodiment, included in this patent application are intended to make it more practical for sleeping persons, the infirm, patients, desiring drink in a dark environment to be able to access drink from a bedside or otherwise adjacent table or stand etc. without spill or disruption of the dark environment.

Other applications for both in-doors and out-doors uses will become apparent.

I claim:

1. A vessel and base combination for use within darkness, the vessel and base combination comprising:

(a) a receptacle, the receptacle having a to end and a bottom end, the receptacle being selected from the group consisting of drink glasses, bottle holders, and carafes;

(b) a coaster, the coaster having a rim fitted for receiving the receptacle's bottom end, the vessel and base combination's base comprising the coaster;

(c) a first band fixedly attached to the receptacle's bottom end, the first band being composed of photo-luminescent plastic; and (d) a second band comprising the coaster's rim, the second band being composed of photo-luminescent plastic, the second band, upon the coaster's receipt of the receptacle's bottom end, encircling the first band.

2. The vessel and base combination of claim 1 wherein the receptacle is molded from a plastic resin.

3. The vessel and base combination of claim 1 wherein the receptacle has a closed bottom and circular walls terminating in a second rim at an open top.

4. The vessel and base combination of claim 1 wherein the coaster is molded from a plastic resin.

5. The vessel and base combination of claim 1 wherein the coaster has a planar surface with a circular perimeter, and wherein the coaster's rim is angular.

6. The vessel and base combination of claim 1 wherein the first and second bands are horizontal.

7. The vessel and base combination of claim 6 wherein the first and second bands are molded from a plastic resin with a phosphorescent pigment in the plastic resin.

8. The vessel and base combination of claim 6 wherein the first and second bands have shapes presenting oblique superior surfaces.

9. The vessel and base combination of claim 6 wherein the receptacle has an exterior surface, and wherein the first horizontal band is bonded to the exterior surface.

10. The vessel and base combination of claim 6 wherein the second band is bonded to the coaster's rim.

* * * * *

UNITED STATES PATENT AND TRADEMARK OFFICE

CERTIFICATE OF CORRECTION

PATENT NO. : 9,186,005 B1
APPLICATION NO. : 13/999999
DATED : November 17, 2015
INVENTOR(S) : Ted Lawrence Ferrier, Jr.

It is certified that error appears in the above-identified patent and that said Letters Patent is hereby corrected as shown below:

In The Specification

At column 4, line 40, text is amended as follows:

"(a) a receptacle, the receptacle having a top end . . ."

Signed and Sealed this
Twelfth Day of April, 2016

Michelle K. Lee

Michelle K. Lee
*Director of the United States Patent and Trademark Office*